US006390206B1

(12) United States Patent
Aardal

(10) Patent No.: US 6,390,206 B1
(45) Date of Patent: May 21, 2002

(54) CORE SAMPLER

(76) Inventor: Kåre Aardal, N-6740, Selje (NO)

( * ) Notice: Subject to any disclaimer, the term of this patent is extended or adjusted under 35 U.S.C. 154(b) by 0 days.

(21) Appl. No.: 09/486,176

(22) PCT Filed: Aug. 22, 1998

(86) PCT No.: PCT/NO98/00246

§ 371 Date: Feb. 22, 2000

§ 102(e) Date: Feb. 22, 2000

(87) PCT Pub. No.: WO99/10620

PCT Pub. Date: Mar. 4, 1999

(30) Foreign Application Priority Data

Aug. 22, 1997 (NO) ..... 973858

(51) Int. Cl.[7] ..... E21B 7/12
(52) U.S. Cl. ..... 175/6; 175/58
(58) Field of Search ..... 175/5, 6, 7, 8, 175/10, 58, 50, 60

(56) References Cited

U.S. PATENT DOCUMENTS 2,176,477 A 10/1939 Varney et al.
3,412,814 A 11/1968 Rosfelder
3,436,914 A 4/1969 Rosfelder
3,561,547 A 2/1971 Pullos
3,621,924 A * 11/1971 Lebourg ..... 175/58
3,870,112 A * 3/1975 Castel et al. ..... 175/93
4,258,803 A * 3/1981 Thompson ..... 175/233
4,572,304 A 2/1986 Mahar et al.
4,664,205 A * 5/1987 Knighton et al. ..... 175/58
5,351,765 A * 10/1994 Ormsby ..... 175/58

* cited by examiner

*Primary Examiner*—Frank Tsay
(74) *Attorney, Agent, or Firm*—Akerman Senterfitt

(57) ABSTRACT

A hydrostatic working device for taking samples from the bottom of the sea. The working device has an outer tube (1), the cylinder tube (1), the cylinder tube with lead-through (5 and 7), and an inner tube (2), the sampling tube with a piston, whereby the space between the outer tube (1) and the inner tube (2), with the piston at the upper end, constitutes a low pressure chamber (29) filled by air under a moderate pressure, in order to keep the sampling tube (2) in an upper position until the valve opens for a working stroke. When the working device is used as a corer the sampling tube is at its lower end equipped with a catcher (4). When the tool is used as a CPT the lead-throughs (5 and 7) are replaced by (20 and 40) and the piston (3) with a piston (19), and the sampler tube (2) is replaced by a probe, and a choke valve (14) is replaced by a pressure compensated volumetric flow valve (39).

11 Claims, 12 Drawing Sheets

CORE SAMPLER

BACKGROUND AND SUMMARY OF THE INVENTION

The invention is a hydrostatically driven working device, in particular a core sampler and a CPT sampler for investigation of sediments on the bottom of the sea, said working device comprising an outer tube (cylinder tube) and an inner tube (sampling tube), or a probe (CPT probe), having a piston fastened to the upper end of the tube/probe and a lead-through having a seal which surrounds the tube/probe at the lower end. This lead-through contains a valve for injecting and discharging air from the space between the outer and inner tube/probe, confined between the piston and the lower lead-through.

To the upper end of the outer tube is fastened a lead-through similar to the lower lead-through, without any air valve, said lead-through having no throughgoing bore for CPT, and to this lead-through is fastened an ear for attachment of a raising wire and with the possibility of attaching a wire for the piston. To the lower lead-through may be fastened a suction anchor for retaining to the bottom during the working stroke.

The working stroke starts when the raising wire becomes so slackened that the spring may open the valve which admits water through the choke valve to the piston, which is driven slowly downwardly, until the neck of the piston, having the same diameter as the sampling tube, passes the seals, and the working stroke starts when the water gets free access to the area between the outer and inner tube, the space between the piston and the lower lead-through being filled by air at an excess pressure which keeps the piston in its upper position until the valve opens.

For CPT the entire area above the piston will be a pressure area, and the stroke velocity will be adjusted to 2 cm/sec. by a pressure compensated flow rate regulation valve. Upon termination of the stroke the air cushion between the piston and the lower lead-through will expand and pull the tube back to its origin during pull-up. The liner will be confined between the catcher at the lower end and the clamping sleeve at the upper end. For expelling of the liner with the sample the clamping sleeve is removed and a piston is inserted in the neck of the piston, and a cover having supply of water is screwed into the neck, whereupon water having an excess pressure pushes out the liner and the sample.

By use of the same technique as for driving the sampling tubes into the sediment support legs may be shot down into the sediment in order to stabilize the sampler, said support legs being fastened to a device which can slide along the outer tube, the plate connecting the support legs being a brake against the raising forces during the shoot-down.

The invention may be combined as a twin, with one unit being a corer and another being CPT (Core Penetration Test), firmly connected to each other.

BRIEF DESCRIPTION OF THE DRAWINGS

The invention will be closer explained in association to examples of embodiments shown on the accompanying drawings.

DETAILED DESCRIPTION OF THE PREFERRED EMBODIMENTS OF THE INVENTION

Figure 1:
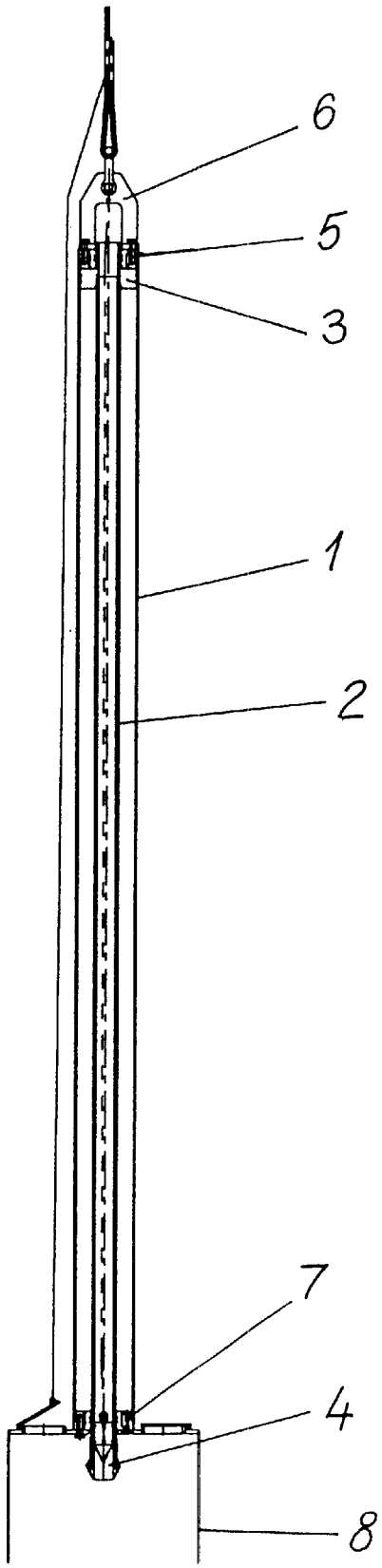
FIG. 1 shows a section through a first embodiment of a hydrostatic working device according to the invention.

FIG. 1 shows a section through a hydrostatic working device, in particular a corer, according to the present invention. The sampler consists of an outer tube (cylinder tube) 1 acting as a drive cylinder and an inner tube (sampling tube) 2 being a piston rod. At its upper end the piston rod has a piston 3 and at its lower end a catcher 4. The cylinder tube 1 has at its upper end a lead-through 5 for the neck of the piston 3 and with a fastener for a raising device 6. At the lower end of the cylinder 1 is positioned a lead-through 7 for the piston rod 2 and with a fastener for a suction anchor 8. The cylinder 1 and the tube 2 may be composed of several lengths. The lead-through 5 and 7 may have a replaceable sleeve 41 with a gasket 42.

Figure 1A:
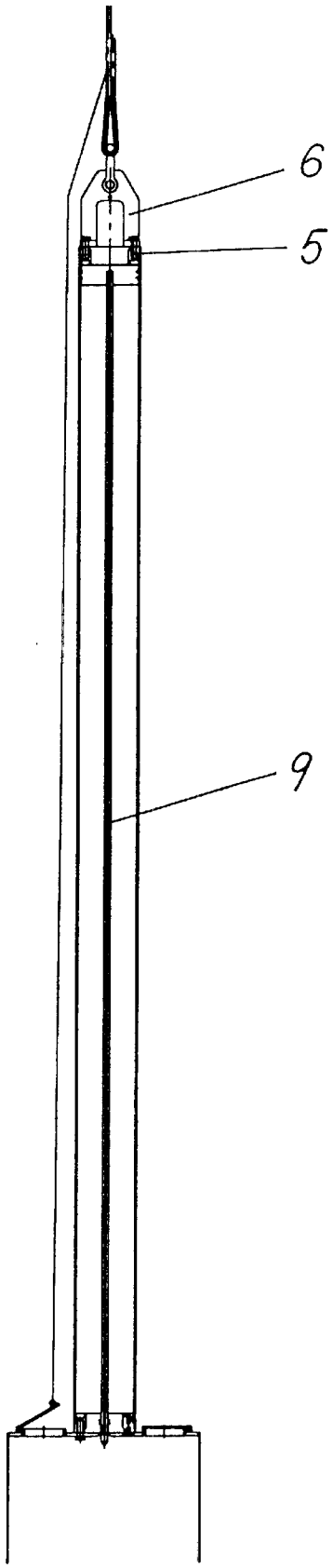
FIG. 1*a* shows a variant of the embodiment of FIG. 1.

FIG. 1*a* shows a variant of FIG. 1 where the sampling tube has been replaced by a CPT probe 9. The CPT probe may be composed of several lengths.

Figure 2:
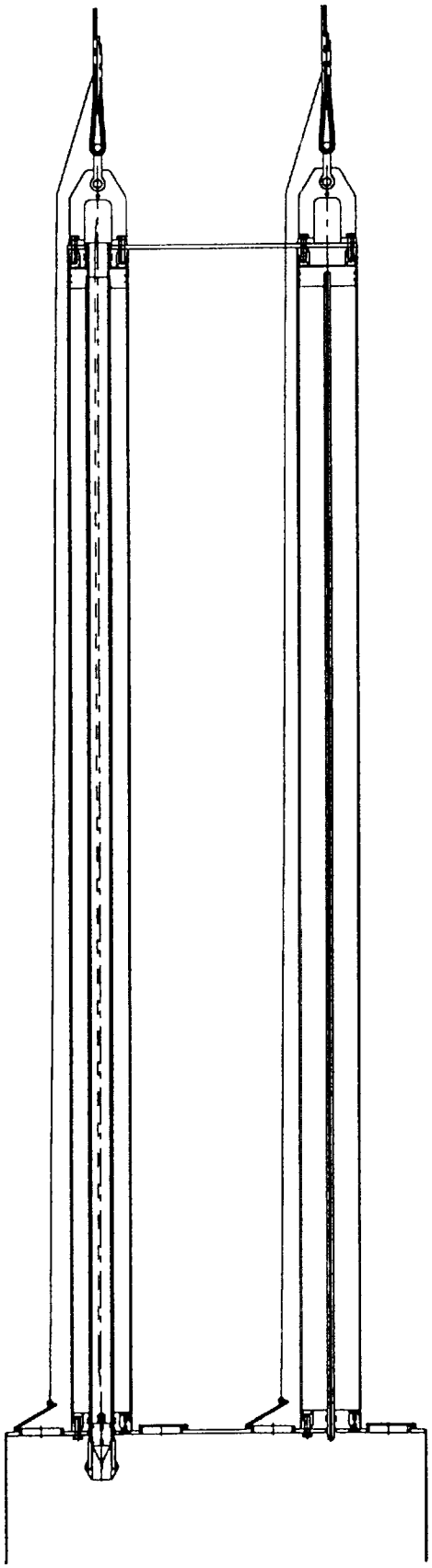
FIG. 2 shows a twin-embodiment of FIG. 1 and FIG. 1*a*.

FIG. 2 shows a combination of FIG. 1 and FIG. 1*a* constituting a permanent unit.

Figure 3:
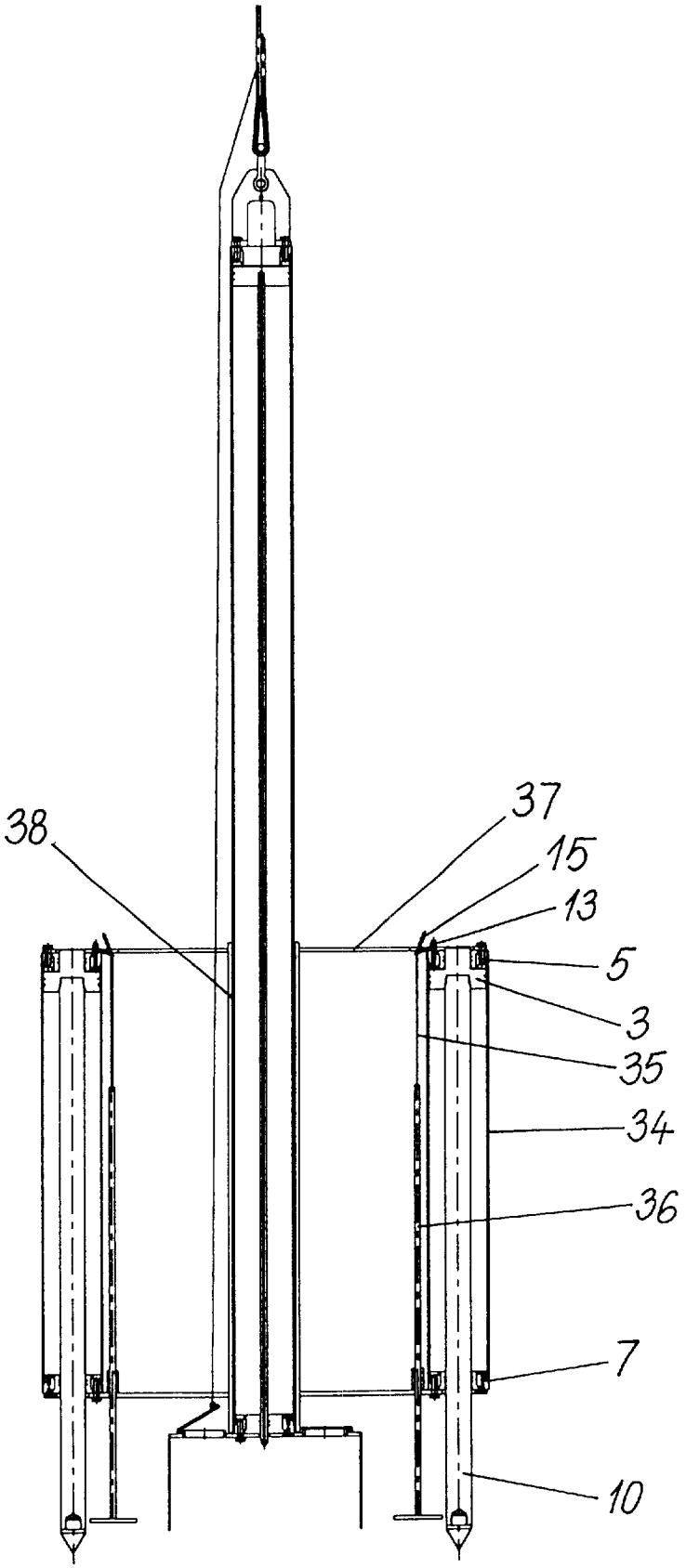
FIG. 3 shows FIG. 1*a* and additional support legs.

FIG. 3 shows 1*a* having support legs 10. The support leg consists of a cylinder 34, support leg 10, piston 3, lead-through 5 and 7, valve 13, spring 15, rope 35, rod having a support plate 36 and a frame 37 with a guide tube 38. The support leg is shot down into the sediment when the support plate 36 reaches the bottom and the spring 15 can open the valve. Counterforce against the forcing down is constituted by flow resistance against the top and bottom plate of the frame 37.

Figure 4:
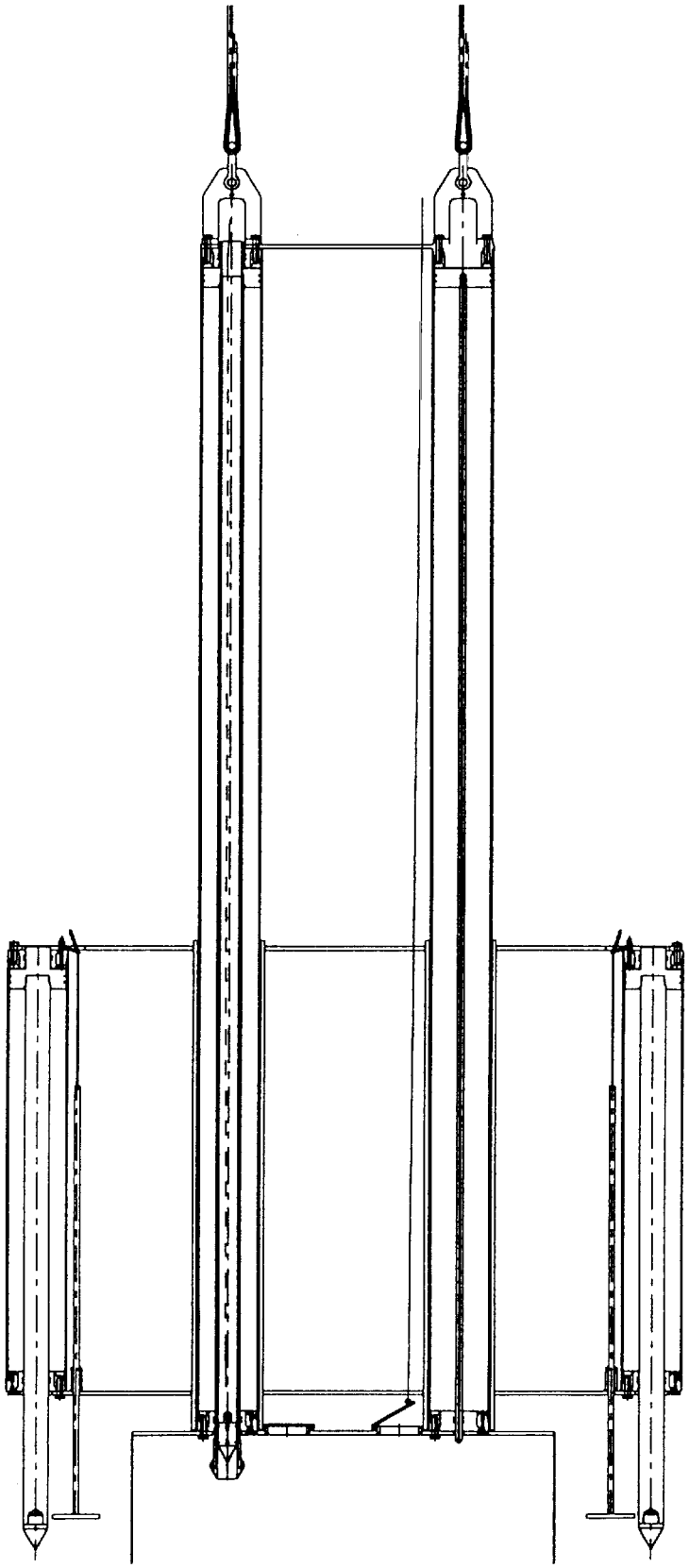
FIG. 4 shows FIG. 2 having support legs.

FIG. 4 shows a twin version of FIG. 3.

Figure 5:
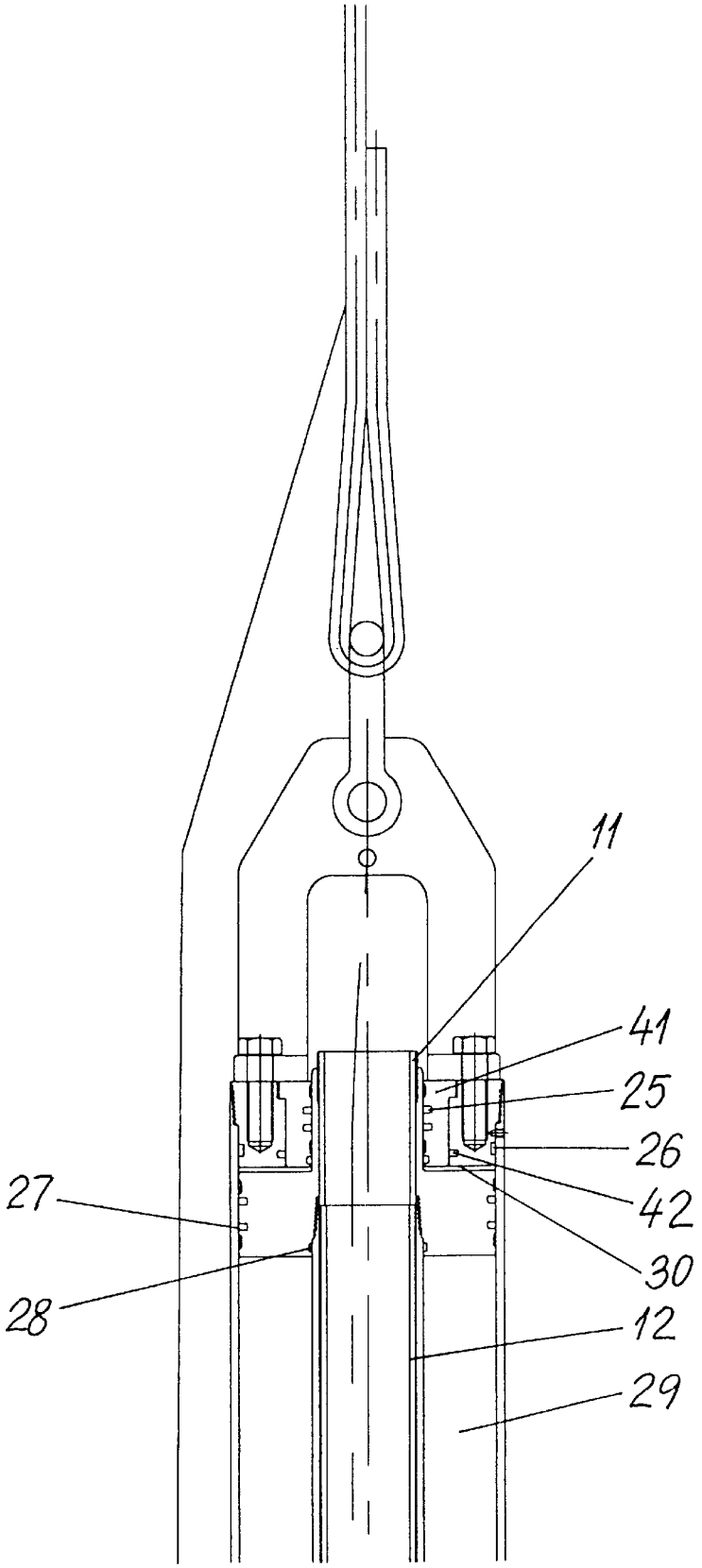
FIG. 5 shows a detail of the upper end of FIG. 1.

FIG. 5 shows a detail of the upper end of FIG. 1, with a clamping sleeve 11 and a liner 12.

Figure 6:
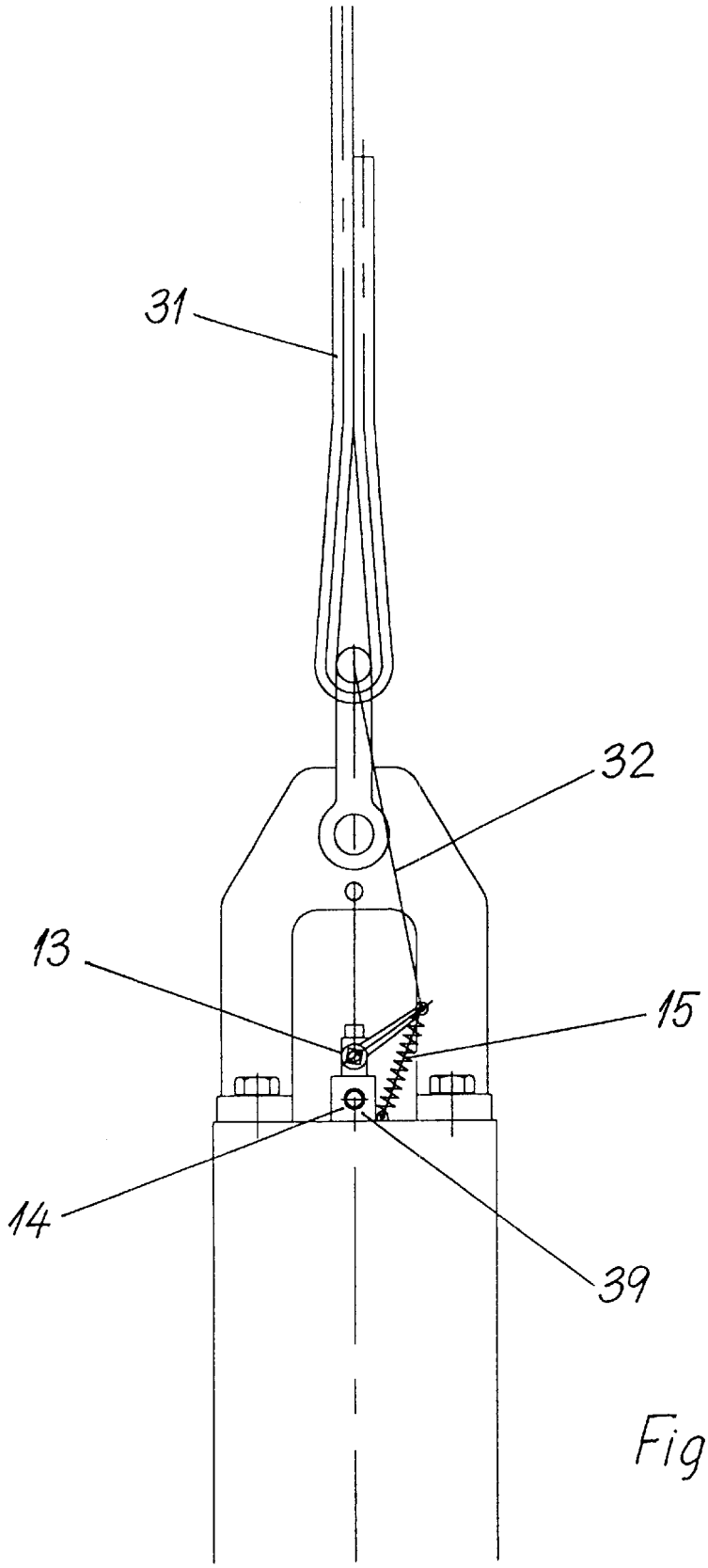
FIG. 6 shows a detail of a device for controlling an inlet valve.

FIG. 6 shows the upper end of FIG. 1, with an inlet valve 13, a pressure compensated flow rate regulation valve 14 and a valve spring 15.

Figure 7:
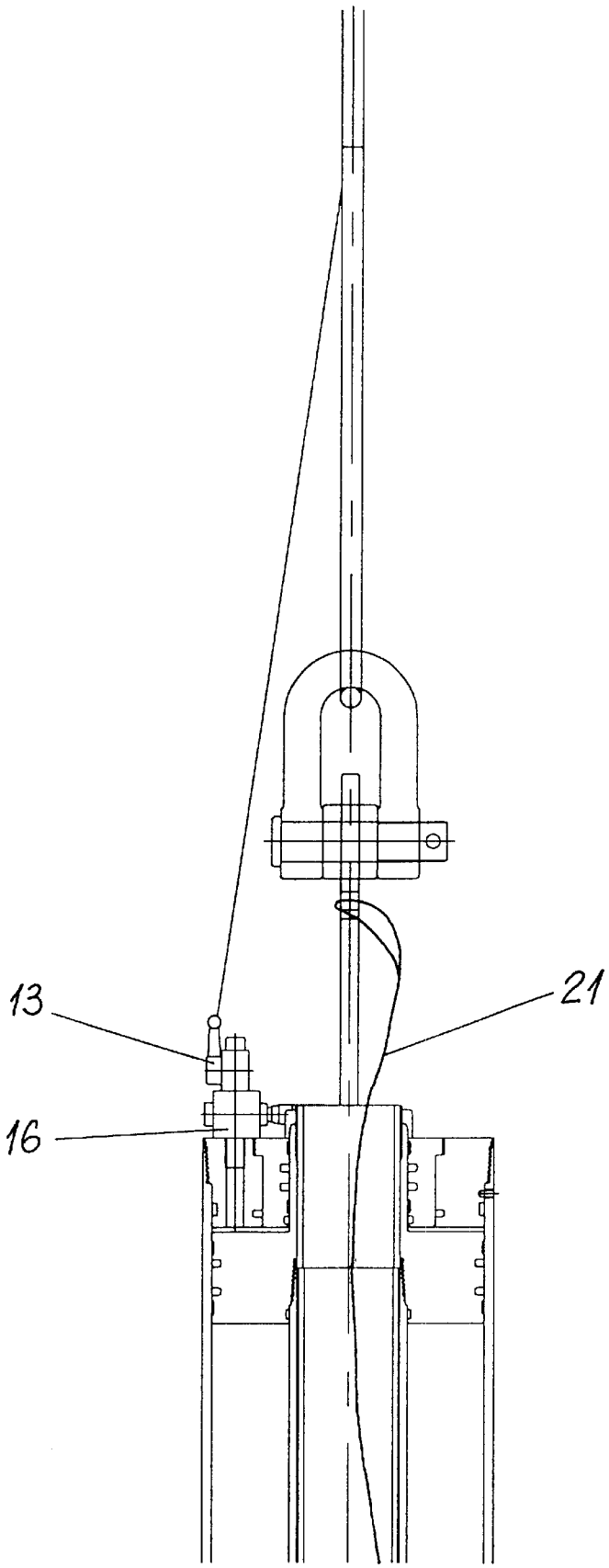
FIG. 7 shows a detail of the same device.

FIG. 7 shows the upper end of FIG. 1, with an inlet valve 13, a choke valve 16 and a wire for a piston 21.

Figure 8:
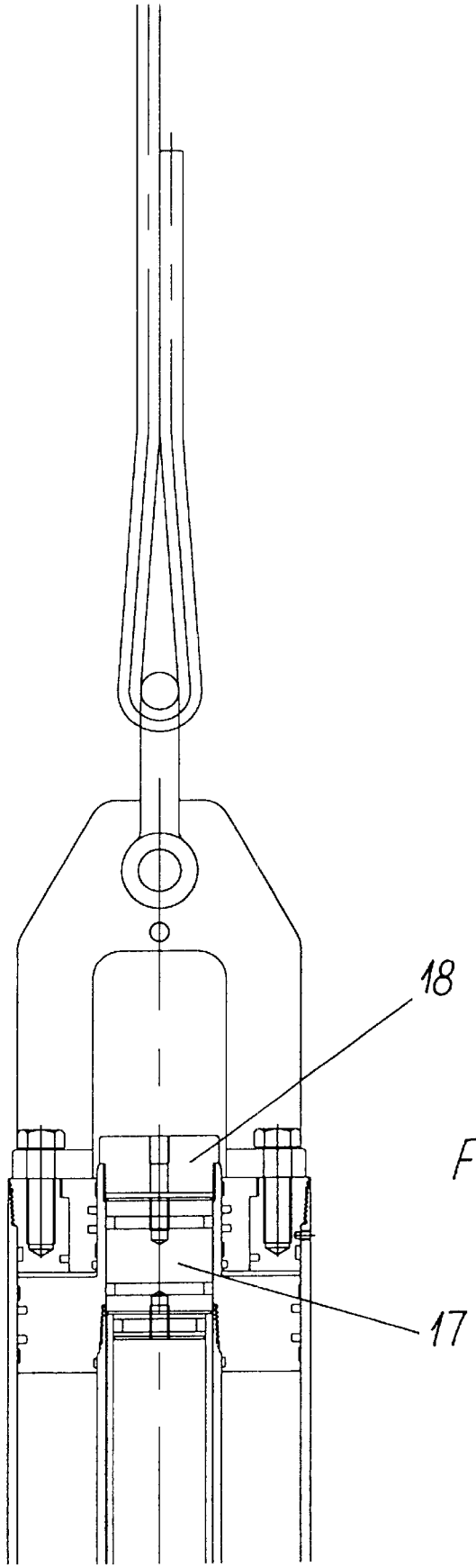
FIG. 8 shows a detail for expelling of liner with sample.

FIG. 8 shows a device for expelling of a liner with a sample, a piston 17 and an inlet seal 18.

Figure 9:
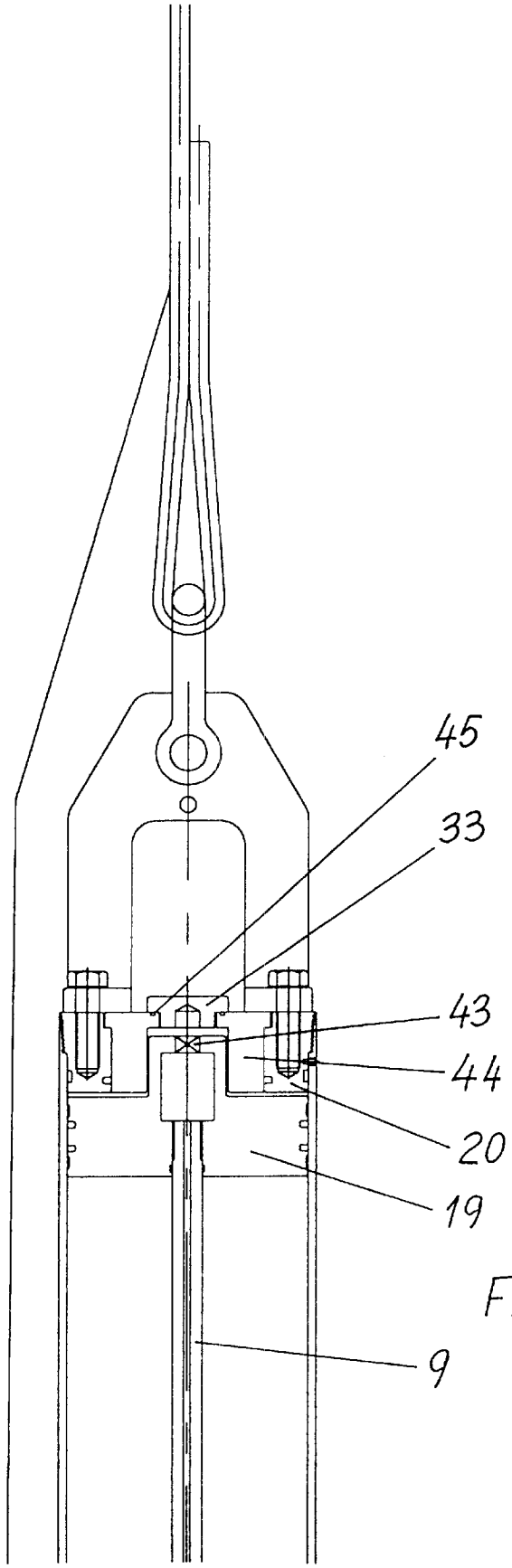
FIG. 9 shows a detail from the top of FIG. 1.

FIG. 9 shows a detail of the upper end of FIG. 1*a*, with a piston 19, which may have a sealed chamber for electronical storing of data, with a drain plug 43 and CPT probe 9 and cover 20 with sleeve 44 and plug 33 with seal 45.

Figure 10:
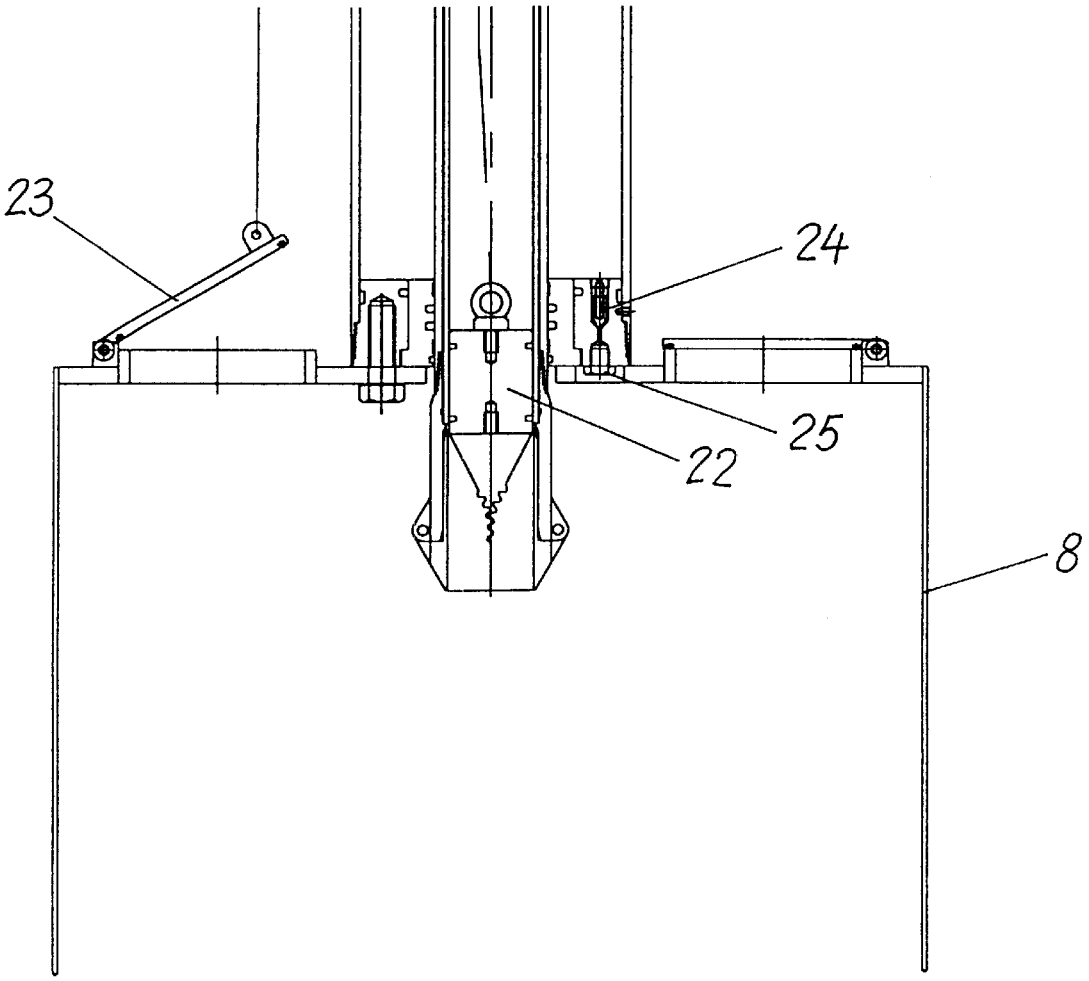
FIG. 10 shows a detail of the lower end of FIG. 1.

FIG. 10 shows a piston 22, a suction anchor 8, a flap valve 23, an air regulation valve 24 and a plug 25.

Figure 10B:
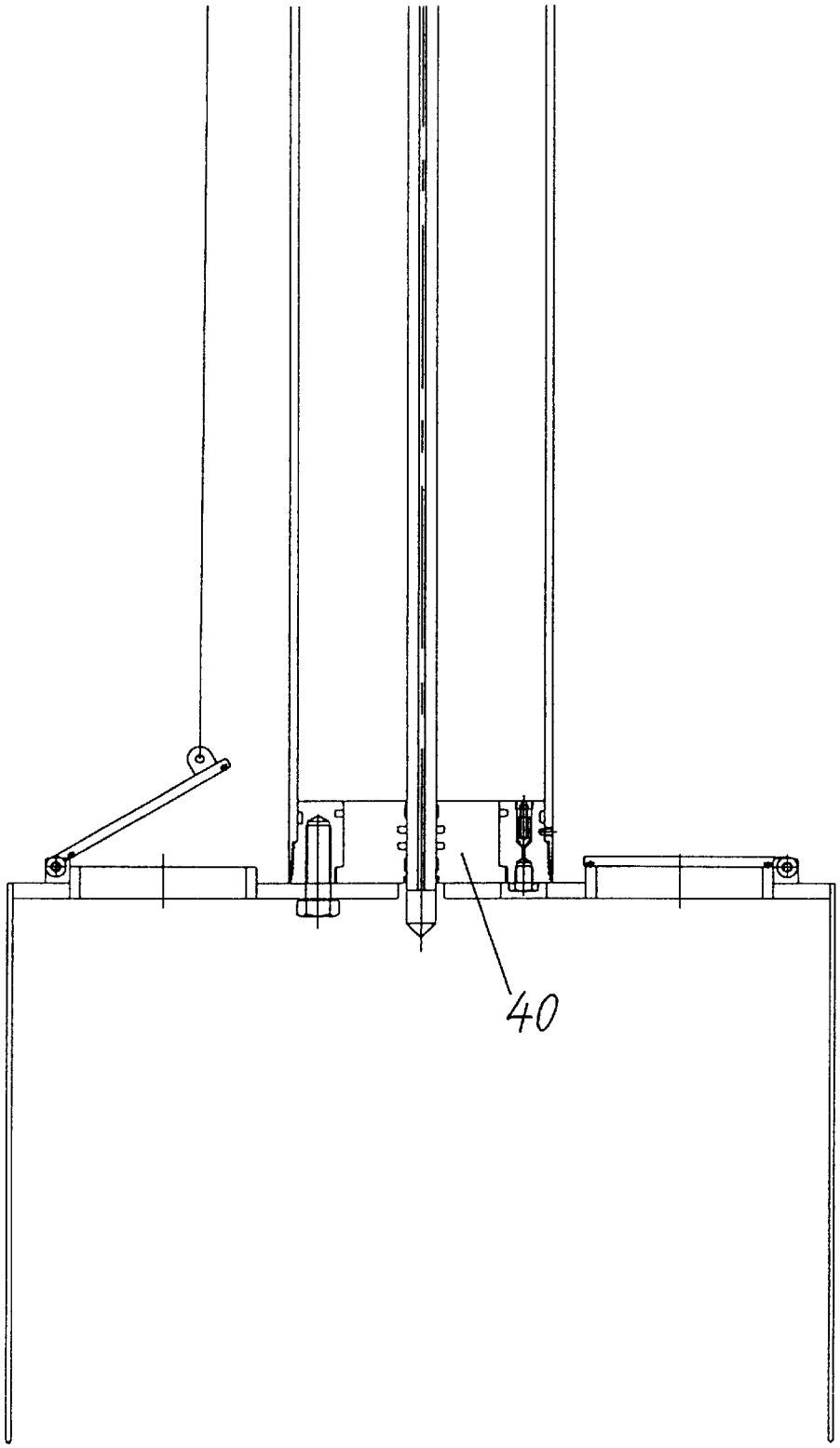
FIG. 10*b* shows a detail of the lower end of FIG. 1*a*.

FIG. 10*b* shows FIG. 10 in a CPT version.

FIG. 5 shows gaskets 25, 26, 27 and 28 which prevent water from getting into the cylinder chamber 29 and the slit 30 before the inlet valve 13 opens.

FIG. 6 shows the function of the valve device where the valve 13 is closed when the pull-up wire 31 is tightened because the rope 32 is fastened to the wire. The spring 15 opens the valve when the sampler reaches the bottom and the wire becomes slackened.

FIG. 7 shows a choke valve 16 which admits the water into the chamber above the piston 3 and the upper lead-through 5, whereby the sampling tube is driven slowly down in order that the suction anchor 8 shall be given time for settling before the end of the neck of the piston passes the gaskets and permits free entry of water through the opening which equals the diameter of the piston rod. The area between the piston rod 2 and the cylinder 1 then becomes a pressure area, because the chamber 33 has air at a moderate pressure. The working stroke will occur rapidly until the air cushion is compressed and the stroke ceases, and the sampler can be lifted back to the vessel. During the stroke the piston 22 will be kept in place by the wire 21 which is fastened to the lifting device 6, whereby a vacuum will be created below the piston, and an increased recovery will occur.

FIG. 8 shows a device for expelling the liner 12 with a sediment sample, whereby the clamping sleeve 11 is replaced by a piston 17 and an inlet seal 18. After firstly having removed the catcher 4, the seal 18 is subjected to water pressure, whereby the piston 17 will expel the liner with the sample.

FIG. 9 shows the CPR version, where the cover 20 is sealed, with inlet only through the inlet valve 13 and a pressure compensated volumetric valve 14, in order to cause a constant velocity of 2 cm/sec.

FIG. 10 shows the suction anchor 8, having a flap valve 23 for promoting the penetration into the sediment and simplifying the lifting when the working stroke is finished. The purpose of the suction anchor is to keep the sampler fastened to the bottom during the working stroke. The valve 24 is used to blow air into the chamber 33 in order to keep the sampler tube in place in the upper end until the working stroke starts and for pulling the tube back when the sampler is pulled up from the sediment. The plug 25 prevents ingress of water.

FIG. 10*b* shows the CPT lead-through.

What is claimed is:

1. A hydrostatic working device for use as at least one of a core sampler and a core penetration test sampler, for sampling of sediments at the bottom of the sea, wherein the working device comprises:

an inner tube;

an outer cylindrical tube having an upper lead-through and lower lead-through near ends of said inner tube, said lead-throughs having gaskets;

a first piston movable in an annulus between the outer tube and the inner tube, said inner tube acting as a piston rod for the first piston;

a catcher situated on a suction anchor which counteracts penetration forces; and a choke valve, wherein said first piston and said outer tube define sealed chambers below and above the first piston;

wherein a flow velocity into the sealed chamber above the first piston can be regulated by said choke valve; and wherein the sealed chamber below the first piston constitutes a low pressure reservoir.

2. A hydrostatic working device according to claim 1, wherein said lead-throughs are cylindrical and have the same diameter.

3. A hydrostatic working device according to claim 1, further comprising a lifting device provided at the top of the upper lead-through.

4. A hydrostatic working device according to claim 1, wherein said suction anchor is provided at the lower lead-through, and includes a flap valve and an open-up cord fastened to a lifting wire.

5. A hydrostatic working device according to claim 1, further comprising a first inlet valve having an open-up spring and a cord, said first inlet valve being provided at the upper lead-through.

6. A hydrostatic working device according to claim 1, wherein said first piston has a neck with the same outer diameter as the inner tube, which defines said sealed chamber above the first piston during an initial part of a working stroke of the first piston.

7. A hydrostatic working device according to claim 1, wherein the device has a core penetration test arrangement, which includes a sealing upper lead-through and a pressure compensated volumetric flow valve to cause a constant velocity during the entire working stroke.

8. A hydrostatic working device according to claim 1, further comprising a liner kept in place by a clamping sleeve, which for expelling is replaced by a second piston and a second inlet seal.

9. A hydrostatic working device according to claim 1, wherein the lower lead-through has an air regulation valve and a plug for regulation of air pressure in the chamber.

10. A hydrostatic working device according to claim 1, wherein a third piston is situated at the lower end of a liner and a cord connects the third piston to a lifting device.

11. A unit comprising two hydrostatic working devices according to claim 1, one said working device comprises a core sampler and the other said working device comprises a core penetration test sampler combined into said unit.

* * * * *